US009746871B2

(12) United States Patent
Gupta et al.

(10) Patent No.: US 9,746,871 B2
(45) Date of Patent: Aug. 29, 2017

(54) NOISE CANCELING CURRENT MIRROR CIRCUIT FOR IMPROVED PSR

(71) Applicant: STMicroelectronics International N.V., Amsterdam (NL)

(72) Inventors: Nitin Gupta, Kurukshetra (IN); Abhirup Lahiri, Delhi (IN)

(73) Assignee: STMicroelectroinics International N.V., Amsterdam (NL)

( * ) Notice: Subject to any disclaimer, the term of this patent is extended or adjusted under 35 U.S.C. 154(b) by 0 days.

(21) Appl. No.: 14/839,693

(22) Filed: Aug. 28, 2015

(65) Prior Publication Data

US 2015/0370281 A1 Dec. 24, 2015

Related U.S. Application Data

(62) Division of application No. 13/784,681, filed on Mar. 4, 2013, now Pat. No. 9,146,574.

(51) Int. Cl.

| | |
|---|---|
| ***G05F 3/04*** | (2006.01) |
| ***G05F 3/26*** | (2006.01) |
| ***G05F 3/02*** | (2006.01) |

(52) U.S. Cl.

CPC ..... *G05F 3/262* (2013.01); *G05F 3/02* (2013.01)

(58) Field of Classification Search

CPC .. G05F 3/18; G05F 3/30; G05F 3/262; H13K 5/1252

USPC ..... 323/311–317; 327/538–543, 551

See application file for complete search history.

(56) References Cited

U.S. PATENT DOCUMENTS

| | | | | |
|---|---|---|---|---|
| 6,285,246 | B1 | 9/2001 | Basu | |
| 6,433,528 | B1 * | 8/2002 | Bonelli | G05F 3/262 323/314 |
| 6,492,796 | B1 | 12/2002 | Morley | |
| 7,015,744 | B1 * | 3/2006 | Holloway | H03K 17/223 323/315 |
| 7,123,075 | B2 | 10/2006 | Iorga | |
| 7,411,376 | B2 | 8/2008 | Zhang | |
| 2005/0248393 | A1 * | 11/2005 | North | G11B 20/24 327/551 |
| 2009/0184752 | A1 | 7/2009 | Kudo | |
| 2012/0098506 | A1 * | 4/2012 | Hu | G05F 3/30 323/265 |

OTHER PUBLICATIONS

Mozhgan Mansuri et al., "A Low-Power Adaptive Bandwidth PLL and Clock Buffer with Supply-Noise Compensation," IEEE Journal of Solid-State Circuits, vol. 38, No. 11, Nov. 2003, pp. 1804-1812.

* cited by examiner

*Primary Examiner* — Nguyen Tran
(74) *Attorney, Agent, or Firm* — Seed Intellectual Property Law Group LLP

(57) ABSTRACT

A current mirror circuit provides a current to drive a load. A noise cancelling circuit is provided to keep the load current constant in spite of variations in the supply voltage. The noise cancelling circuit includes an auxiliary current path which branches from the load current path. The length-to-width ratios of transistors of the circuit are selected to provide the desired noise cancellation while maintaining device stability.

16 Claims, 3 Drawing Sheets

NOISE CANCELING CURRENT MIRROR CIRCUIT FOR IMPROVED PSR

BACKGROUND

Technical Field

The present disclosure relates to the field of electrical circuits. The present disclosure relates more particularly to current mirror circuits driving a load.

Description of the Related Art

Current mirror circuits are used in many applications to supply a controlled current to a load. A typical current mirror includes a current source that passes a selected current through a diode connected transistor. A voltage is forced on the gate of the transistor according to the current flowing through the transistor. The current source therefore biases the gate of the transistor according to the current being forced through the transistor. The gate voltage from the transistor is then supplied to the gate of the second transistor. Typically the sources of the two transistors are connected to the same voltage, thereby causing the current flowing through the second transistor to be the same as or a scalar factor of the current flowing through the first transistor, according to the width to length ratios of the transistors.

FIG. 1 illustrates a prior art current mirror circuit 20 used to drive a current through a load. The current mirror circuit 20 includes a current source I1 driving a bias current through PMOS channel transistor T1. The source of the high transistor T1 is connected to the voltage $V_{DD}$. The gate of transistor T1 is connected to the drain of transistor T1.

When a transistor is in saturation mode, the current flowing through the transistor depends largely on the voltage difference between the gate and the source of the transistor. As the difference between the gate and the source voltage increases, the current flowing through the transistor increases. Because the gate of transistor T1 is coupled to the drain of transistor T1, the voltage at the drain of transistor T1 will be the voltage relative to $V_{DD}$ which will cause a drain current in T1 equal to the bias current driven by current source I1.

The current mirror circuit 20 includes a transistor T2, the source of which is coupled to $V_{DD}$ and whose gate is coupled to the gate of transistor T1. The gate to source voltage of transistor T2 is therefore the same as the gate to source voltage of transistor T1. The current flowing through transistor T2 will therefore mirror the current flowing through transistor T1. A load is coupled between the drain of transistor T2 and ground voltage GND.

In this configuration the current supplied to the load is controlled by the current source I1 and transistor T1. This is so a steady current can be supplied to the load regardless of the resistance of the load. If the resistance of the load changes, the current being supplied to the load will remain the same.

Problems can arise, however, when there are fluctuations in the supply voltage $V_{DD}$. While the current flowing through the load may be stable in spite of changes in the load resistance, changes in the supply voltage $V_{DD}$ can alter the current flowing through to the load. Fluctuations in the supply voltage introduce noise into the circuit, and thus cause noise in the load current. For some types of loads, any noise in the load current can be very undesirable and can have negative effects on the function of the load.

Efforts have been made to improve the power supply rejection ratio (PSR) of current mirror circuits driving a load in order to make the load current tolerant to power supply variation. In other words, efforts have been made to have the load current be highly insensitive to variations in supply voltages.

One way to improve PSR is to increase the output resistance $r_{02}$ of the load transistor T2. In the circuit 20 of FIG. 1, this can only be done by increasing the channel length L of transistor T2.

A second method for increasing the output resistance $r_{02}$ of the load transistor T2 is to introduce a cascode amplifier in the load current path. FIG. 2 illustrates a current mirror circuit 20 including a cascode amplifier formed from transistors T2 and T3. Transistor T3 is coupled between the load and transistor T2. The gate of transistor T3 is coupled to the gate of transistor T4. Transistor T4 is biased by current source I2. The current source I2 is controlled by the current source I1. This configuration increases the output resistance $r_{02}$ by a factor of the gain of the cascode amplifier. While the current mirror circuit 20 of FIG. 2 effectively improves the output resistance and the PSR, higher power supply voltages may be required to ensure operability of the circuit 20.

FIG. 3 illustrates a current mirror circuit 20 including a regulated cascode current mirror. The regulated cascode current mirror includes an amplifier 24 having a non-inverting input coupled to the source of transistor T3 and an inverting input coupled to a reference voltage $V_{ref}$. The reference voltage $V_{ref}$ is $V_{DD}$ referred. The current mirror circuit 20 of FIG. 3 further increases the output resistance $r_{02}$ and the PSR. In particular the output resistance $r_{02}$ is further increased by the gain of the amplifier 24. The gain of the amplifier 24 can be very high, greatly increasing the output resistance $r_{02}$.

However, the regulated cascode circuit of FIG. 3 includes increased voltage demands and can't be designed to work at lower voltages. Higher supply voltages may be required than even those of the cascode current mirror circuit of FIG. 2.

Another method for improving PSR is the bootstrap current mirror, which, instead of increasing output resistance at the cost of supply voltage, increases the output resistance at the cost of device stability. The output resistance is increased at the cost of increased current consumption. If current consumption needs to be reduced, the phase noise will get worse in the case of a Voltage Controlled Oscillator.

BRIEF SUMMARY

One embodiment of the present invention is a current mirror circuit which supplies a load current to a current sensitive load. The current mirror circuit includes a bias stage which biases a load transistor. The load transistor passes both a DC current and a noise current. A selected portion of the DC current is a load current supplied to a load. The current mirror circuit includes a noise canceling circuit which renders the load current insensitive to variations in the supply voltage.

The noise canceling circuit includes a noise cancelling path in parallel with the load. Both the load and the noise cancelling path receive current from the load transistor. The noise cancelling path draws a relatively small portion of the DC current from the load transistor. The load receives a relatively large portion of the DC current from the load transistor. This large portion of the DC current is the load current.

On the other hand, the noise cancelling path draws a relatively large portion of the noise current from the load transistor. Because the noise cancelling path draws a large portion of the noise current from the load transistor, only a small portion of the noise current from the load transistor is passed to the load. In this way, the load is shielded from noise which can be introduced into the current mirror circuit.

In one embodiment the noise canceling circuit introduces positive feedback into the current mirror circuit of small signal variations in the supply voltage, which represents the noise in the supply voltage. When small signal variations occur in the supply voltage, the noise canceling circuit responds in a positive manner and passes a comparatively large portion of the noise current through the noise canceling transistor. Thus when noise is introduced into the power supply, the circuit passes a much higher portion of small signal current through the noise canceling path than through the load. The load transistor continues to provide current to the load that is relatively free of noise.

In one embodiment the noise canceling path includes a noise cancelling transistor which passes the noise current from the load transistor. The noise cancelling circuit includes a further bias current generator which biases the noise cancelling transistor. The width-to-length ratios of the transistors of the noise canceling circuit are selected, relative to each other and to the load transistor, to provide the proper noise canceling effect without introducing instability into the circuit.

DETAILED DESCRIPTION

Current mirrors are used to drive currents through many types of loads. As previously described, some loads are more sensitive to variations in the load current and are adversely affected by any noise or other variations in the load current.

A current controlled oscillator is one example of a current sensitive load driven by a current mirror circuit. A current controlled oscillator oscillates at a particular frequency dependent on the current supplied to the current controlled oscillator. When implemented in conjunction with an integrated circuit, the current controlled oscillator is the basis on which a clock signal is generated to provide the integrated circuit, or portions of the integrated circuit, with a clock signal.

Clock signals drive the function of many components of an integrated circuit. In many applications the frequency of the clock signal must be very accurate and stable. If the frequency of a clock signal is unstable or inaccurate, the proper function of the integrated circuit can be adversely affected. A clock signal whose frequency is unstable and inaccurate can destroy the function of the integrated circuit components which rely on particular timing of signals.

Figure 1:
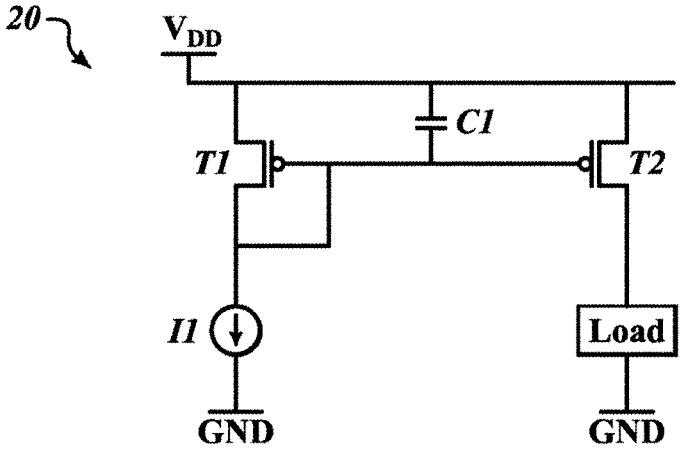
FIG.1 (Prior Art)
FIG. 1 is a schematic diagram of a well-known current mirror circuit.
Figure 2:
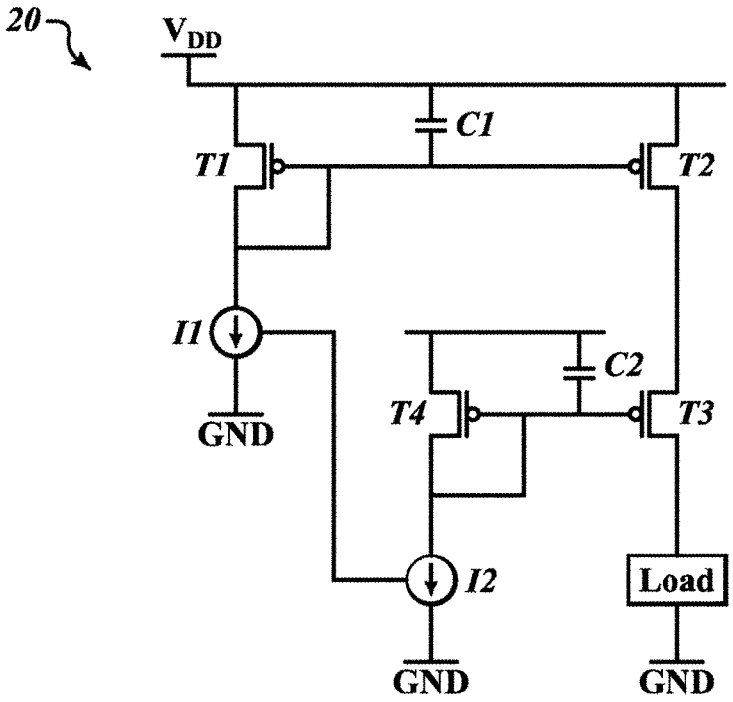
FIG.2 (Prior Art)
FIG. 2 is a schematic diagram of a well-known current mirror circuit including a cascode amplifier.
Figure 3:
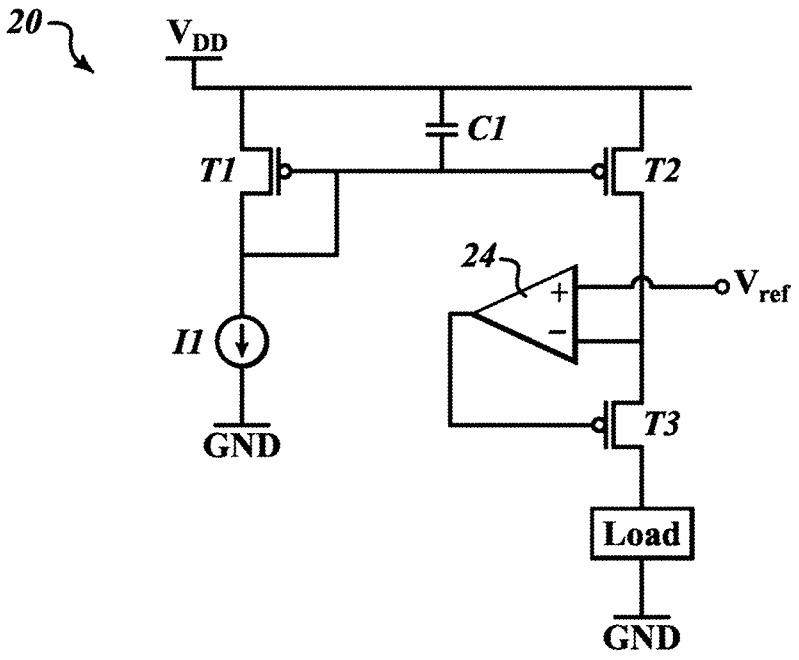
FIG.3 (Prior Art)
FIG. 3 is a schematic diagram of a well-known current mirror circuit including a regulated cascade configuration.

As described previously with respect to FIGS. 1-3, several methods have been used in the prior art to improve PSR of current mirror circuits driving a load. Each of the previously described and known methods increases the output resistance of the load transistor by introducing negative feedback. However, these techniques suffer a trade-off in which output resistance is increased at the price of increasing the supply voltage needed to ensure functionality of circuit.

Figure 4:
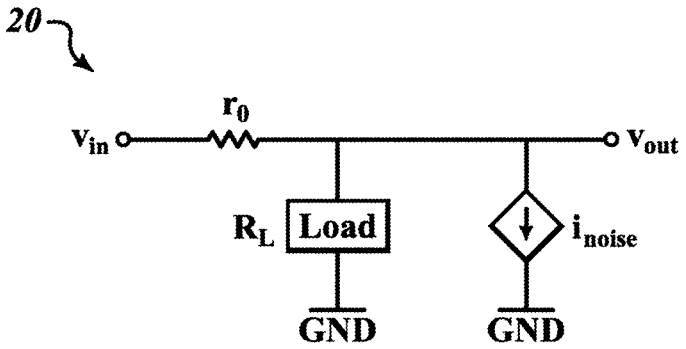
FIG. 4 is a simplified small signal representation of a current mirror circuit according to one embodiment of the present invention.

FIG. 4 is a diagram of the small signal equivalent representation of a current mirror circuit 20 according to one embodiment of the present invention. The current mirror circuit 20 includes a small signal voltage input $v_{in}$, an output node $v_{out}$, and an equivalent resistance $r_0$ coupled between $v_{in}$ and $v_{out}$. (The symbol $V_{DD}$, upper case V, represents the DC voltage supply, whereas the symbol $v_{in}$, lower case v, represents the small signal voltage) The resistance $r_0$ is the output resistance of a load transistor that supplies the current to the load.

A load having an equivalent resistance $R_L$ is coupled between $v_{out}$ and ground GND. In one example the load is a current controlled oscillator. Alternatively, it can be another kind of load through which a load current flows. It is desirable to shield $v_{out}$ from noise or other small changes the voltage $v_{in}$. In other words, in order to protect and ensure proper operation of the load, the voltage $v_{out}$ should be strongly resistant to noise or other small changes in the voltage $v_{in}$. This corresponds to a high value of PSR To improve the PSR of the current mirror circuit 20, a noise canceling current source $i_{noise}$ is coupled between $v_{out}$ and ground in parallel with the load. The current flowing through the current source $i_{noise}$ is given by the following expression:

$$i_{noise}=(v_{in}/r_0)(1/\gamma-\beta)$$

where γ and β are scalar factors that will be described in more detail below. The transfer function of the circuit 20 of FIG. 4 is given by the following expression:

$$v_{out}/v_{in}=((1/r_0)(1-(1/\gamma-\beta))/(1/r_0+1/R_L).$$

If $$\beta=1$$

and $$\gamma=0.5,$$

then the transfer function of the circuit is $$v_{out}/v_{in}=(1/r_0)(1-(1/0.5-1))/(1/r_0+1/R_L)=0.$$

If the transfer function goes to zero then $$PSR=-\infty.$$

In practice, β and γ are selected to drive the transfer function to a small number, such as 0.1. If the circuit components permit, it is desirable to drive the transfer function even closer to zero, such as 0.05 or 0.01. Transfer functions preferentially less than 1.0, in the range of 0.9 to 0.01, are acceptable. The current source $i_{noise}$ therefore introduces a current into the current mirror circuit 20 in parallel with the load. The current introduced by $i_{noise}$ is dependent on variations in $v_{in}$. The current source $i_{noise}$ therefore introduces positive feedback into the current mirror circuit 20 based on variations in the voltage $v_{in}$. Small variations in $v_{in}$ correspond to noise at the input of the current mirror. Because the load is very sensitive to changes in the load current, it is desirable to ensure that changes in the supply voltage $v_{in}$ do not affect the load current.

To this end, the current source $i_{noise}$ passes the current due to variations in the voltage $v_{in}$, while the load current remains constant. In other words the current due to noise is passed through the current source $i_{noise}$ instead of through the load.

Figure 5:
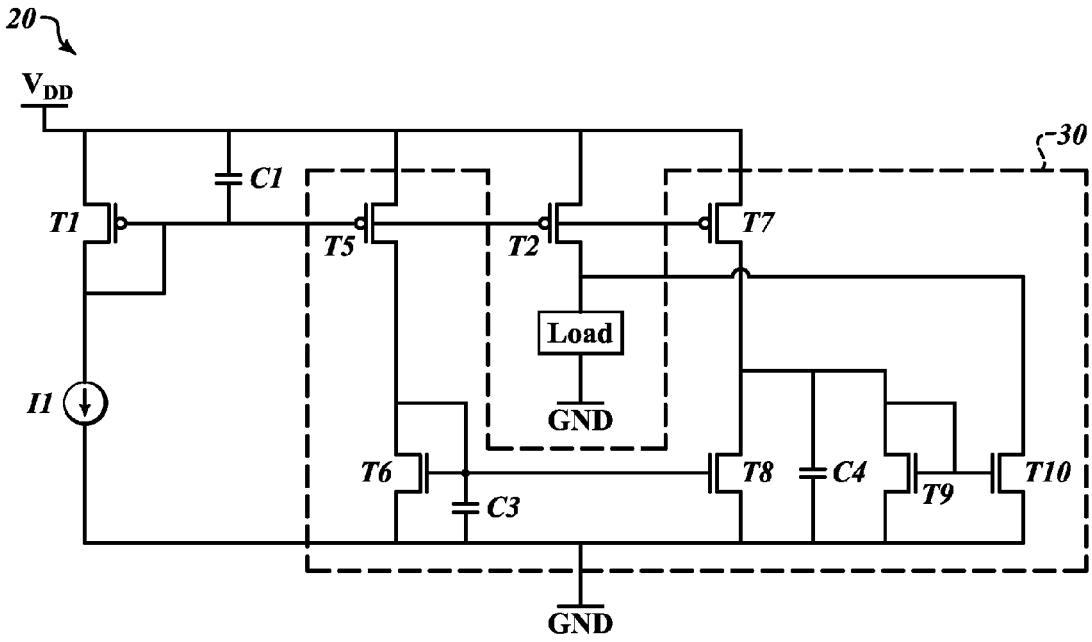
FIG. 5 is a schematic diagram of a current mirror circuit including a noise canceling circuit according to one embodiment.

FIG. 5 is a schematic diagram of a current mirror circuit 20 according to one embodiment. The current mirror circuit 20 includes PMOS bias transistor T1 coupled to current source I1. The current source I1 causes a bias voltage VG to appear on the gate terminal of transistor T1 as described previously. The circuit 20 further includes PMOS transistors T5 and T7, each receiving the bias voltage from the gate of transistor T1 and receiving the supply voltage $V_{DD}$ on their source terminals. The transistors T2, T5, and T7 are therefore biased by transistor T1 and will conduct current according to the gate voltage Vg of T1 and the source voltage Vs, which is $V_{DD}$. As described previously the PMOS transistor T2 conducts the current through the load. Transistor T2 is therefore a load transistor.

The circuit 20 further includes a noise canceling circuit 30. The noise canceling circuit 30 includes PMOS transistors T5 and T7 and NMOS transistors T6 and T8-T10.

Transistor T6 receives the drain current $I_{D5}$ from transistor T5. The gates of transistors T6 and T8 coupled together. The gate of transistor T8 is therefore coupled to the drain of transistor T5 and is biased by transistor T5. Thus the gate voltage of transistor T8 is equal to the drain voltage of transistor T6 and is determined by the drain current $I_{D5}$ flowing through transistor T5. Capacitor C3, once fully charged, holds the voltage stable on the gates of T6 and T8.

The drains of transistors T8 and T9 are coupled to the drain of transistor T7. Each of the transistors T8 and T9 conducts a respective portion ($I_{D8}$ and $I_{D9}$) of the drain current $I_{D7}$ flowing in transistor T7. These portions are controlled in part by the current flowing through transistor T6. This is because the gate to source voltage Vgs of transistor T6 is forced to that voltage which will conduct the drain current from transistor T5. Vgs of transistor T8 is identical to Vgs of transistor T6. Therefore the portion of the drain current $I_N$ of transistor T7 conducted by transistor T8 is based on the bias voltage supplied from the gate of transistor on T6. The remaining portion of the drain current of transistor T7 is conducted by transistor T9. Because the drain of transistor T9 is coupled to the gate of transistor T9 the gate voltage Vg will be forced to the value which will cause transistor T9 to conduct the remaining portion of the drain current $I_{D7}$ of transistor T7.

The drain of transistor T10 is coupled to the drain of the load transistor T2. The gate of transistor T10 is coupled to the gate of transistor T9 and is biased thereby. Transistor T10 conducts a portion of the drain current $I_{D2}$ of transistor T2. The portion of the drain current $I_{D2}$ of transistor T2 conducted by transistor T10 is determined by gate to source voltage $V_{gs}$ of transistor T10, which is the same as T9. The current which transistor T10 draws is forced by transistor T9 to be a selected value. The gate voltage $V_g$ of transistor T10 is thus based on the drain current flowing through transistors T8 and T9. The current flowing through transistor T8 is, thus, based on the current flowing through transistor T6. Therefore, by carefully selecting the parameters of the transistors T5-T10, the drain current $ID_{10}$ of transistor T10 can be made to conduct a desired portion of the drain current of transistor T2, including the noise current flowing in transistor T2.

The noise canceling circuit 30 functions to keep constant the current flowing through the load in spite of variations in the supply voltage $V_{DD}$. The load transistor T2 conducts a steady DC current which includes the load current flowing through the load, and the current passing through transistor T10. Small variations in the supply voltage $V_{DD}$ appear as noise in the current mirror circuit 20. This noise causes a noise current to flow in the transistors T1, T2, T5, and T7. The noise current is modeled as a small signal AC current. The noise canceling circuit 30 draws a large portion of the noise current flowing in transistor T2 through transistor T10 rather than through the load. In this way the load does not conduct a significant portion of the noise current from transistor T2.

In contrast, transistor T10 conducts a relatively small portion of the DC current from transistor T2, while the current flowing through the load corresponds to a larger portion of the current flowing through transistor T2. Ideally, transistor T10 passes all, or nearly all, of the small signal AC current flowing through transistor T2. In this way the current in the load remains constant in spite of variations in supply voltage $V_{DD}$. Transistor T10 therefore acts as a noise canceling transistor because it passes the noise current from transistor T2 so that the load does not pass the noise current. Because the load is sensitive to any variation in current, the noise canceling circuit 30 is configured to divert the noise current through the noise canceling transistor T10 to avoid passing through the load.

The noise canceling circuit 30 biases the load transistor T10 by advantageously selecting the width-to-length ratios (W/L) of the transistors of the noise canceling circuit 30 with respect to each other and with respect to the load transistor T2. In particular, the width-to-length ratios of the transistors T5-T10 are selected to cause transistor T10 to conduct a very small portion of the DC current $I_{D2}$ flowing through transistor T2. The larger portion of the DC current passing through transistor T2 passes through the load.

The drain current $I_D$ flowing in a transistor in saturation mode is approximated by the expression $$I_D=\mu_n(C_{ox}/2)(W/L)(V_{gs}-V_{th})^2(1+\lambda(V_{ds}-V_{dsat})).$$

In this expression, the factor X is the channel length modulation factor which corresponds to how the drain current in saturation mode increases as the drain to source voltage $V_{ds}$ increases beyond the saturation voltage $V_{dsat}$. $\lambda$ is inversely proportional to $r_0$ of the transistor.

Neglecting $\lambda$, the expression for the drain current further simplifies to the following:

$$I_D=\mu_n(C_{ox}/2)(W/L)(V_{gs}-V_{th})^2.$$

As can be seen from this expression, the drain current is dominated by the gate to source voltage Vgs of the transistor. The drain current increases according to the square of the gate to source voltage Vgs. However, other factors also affect the drain current. The drain current is proportional to the carrier mobility ($\mu_n$ for n-channel devices, $\mu_p$ for p-channel devices). The carrier mobility corresponds to the drift velocity with which holes or electrons move in the presence of an electric field. The carrier mobility is largely determined by the doping concentration of the active areas of the transistor.

In order to reduce manufacturing costs, all of the NMOS transistors in integrated circuit will typically have the same doping concentrations in the active areas. This is because it would take additional process steps, such as photolithography, alignment, and ion implantation steps, for each integrated circuit to include separate NMOS devices having multiple dopant characteristics. Therefore it is not common to adjust the doping concentrations to provide many transistors having different conduction characteristics.

Likewise the gate oxide capacitance $C_{ox}$ is typically not adjusted to produce multiple types of transistors having different gate capacitances on a single integrated circuit due to manufacturing costs.

However, transistors having individualized conduction characteristics can easily be formed by selecting a particular width-to-length ratio (W/L). It is relatively easy to generate mask layouts having transistors with many different width-to-length ratios. As can be seen the expression for drain current above, the drain current $I_D$ of an MOS transistor is directly proportional to the width-to-length ratio. Thus, by increasing the width-to-length ratio of the channel of the transistor, the drain current in saturation mode for a given gate to source voltage $V_{gs}$ can also be increased.

Likewise, as described previously, the output resistance of the transistor in saturation mode is inversely proportional to the channel length L of the transistor. Thus, conductive properties of transistors can be individually tuned by adjusting the width W and the length L of the transistors. By taking account of this fact, the current mirror circuit 20 can be designed with a greatly improved PSR according to principles of the present disclosure.

In one embodiment the load transistor T2 has a width-to-length ratio. Transistor T5 has a width-to-length ratio α(W2/L2). Because the transistors T5 and T2 receive the same voltage on the gates and resources, they would conduct the same current if they had the same width-to-length ratios. However because transistor T5 has a width-to-length ratio which is scaled by a factor of a with respect to transistor T2, the drain current $I_{D5}$ conducted by transistor T5 is given by:

$$I_{D5}=\alpha I_{D2}.$$

Transistor T6 conducts the entire current $I_{D5}$ from transistor T5. Because the drain of transistor T6 is coupled to the gate of transistor T6, the gate voltage $V_g$ on transistor T6 is biased according to the drain current $I_{D5}$.

In the same way as transistor T5, the width-to-length ratio of transistor T7 is scaled by a factor of a with respect to transistor T2. Therefore the drain current conducted in transistor T7 in saturation mode is given by;

$$I_{D7}=\alpha I_{D2}$$

However, the width and length of transistor T7 are each scaled by a factor of γ with respect to the width and the length of transistor T5. Thus, while transistor T7 has the same width-to-length ratio as transistor T5, the width and length of the channel of transistor T7 are each different than the width and length of the channel of transistor T5. In particular each of the width and length of transistor T7 are scaled by a factor of γ with respect to the width and length of transistor T5. Thus the drain current $I_{D7}$ flowing in transistor T7 will be approximately identical to the drain current flowing in transistor T5, because they have the same width-to-length ratios. But because the length of the channel of transistor T7 is different than length of the channel of transistor T5 the output resistance of transistor T7 will be different than the output resistance of transistor T5. While this will not greatly affect the drain current $I_{D7}$ flowing in transistor T7, it will affect the output resistance $r_{07}$ of transistor T7, as will be described in more detail below.

The width-to-length ratio of transistor T8 is scaled by a factor of β with respect to the width-to-length ratio of transistor T6. Thus, because the transistors T6 and T8 are connected in the current mirror configuration, the drain current flowing in transistor T8 will be scaled with respect to transistor T6 by a factor of β.

A portion of the drain current $I_{D7}$ of transistor T7 flows through transistor T8, and another portion flows through transistor T9. In an example in which β is less than one, the drain current $I_{D8}$ flowing in transistor T8 is given by:

$$I_{D8}=\beta I_{D7}.$$

The remaining portion of the drain current $I_{D7}$ that does not flow through transistor T8 flows through transistor T9.

The transistors T9 and T10 are connected in a current mirror type configuration. They have the same gate to source voltage Vgs. However the width-to-length ratio of transistor T10 is scaled with respect to the width-to-length ratio of transistor T9 by factor of 1/α. Thus the drain current $I_{D10}$ flowing in transistor T10 is given by:

$$I_{D10}=(\alpha^{-1})I_{D9}.$$

To ensure that a sufficient load current $I_L$ should be delivered to the load from transistor T2, in one embodiment the drain current $I_{D10}$ flowing in transistor T10 is selected to be a relatively small portion of the drain current $I_{D2}$ flowing in transistor T2. Because transistor T2 supplies the load current $I_L$ to the load, any portion of the drain current $I_{D2}$ that is supplied to transistor T10 is a portion which is not available to drive a load. Therefore, in one embodiment the drain current $I_{D10}$ is a relatively small portion of the drain current $I_{D2}$, for example much less than half of $I_{D2}$. In another embodiment, it is less than 10% of $I_{D2}$.

It is illustrative to describe the drain currents of each of the transistors with respect to the drain current $I_{D2}$ flowing in transistor T2 for one example circuit. The drain currents of the transistors T5, T6, and T7 are given by:

$$I_{D5}=I_{D6}=I_{D7}=\alpha I_{D2}.$$

The drain current $I_{D8}$ is given by:

$$I_{D8}=\beta I_{D2}.$$

The drain current $I_{D9}$ is given by:

$$I_{D9}=\alpha(1-\beta)I_{D2}.$$

And the drain current $I_{D10}$ is given by:

$$I_{D10}=(1-\beta)I_{D2}.$$

As described previously with respect to FIG. 4, the transfer function of the circuit of FIG. 4 is given by:

$$v_{out}/v_{in}=(1/r_{02})(1-(1/\gamma-\beta))/(1/r_{02}+1/R_L).$$

If $$\beta=1,$$

and $$\gamma=0.5,$$

then the numerator of the expression for the transfer function is given by:

$$(1/r_{02})(1-(1/0.5-1))=0.$$

This corresponds to an infinite PSR. However, as can be seen from above, there is no drain current flowing in transistor T10 when β is exactly 1. Because transistor T10 is a noise canceling transistor, as will be described in more detail below, it is desirable for β to be slightly less than one. In one example $$\beta=0.9.$$

Thus the drain current $I_{D10}$ flowing and transistor T10 is given by:

$$I_{D10}=(1-\beta)I_{D2}=(1-0.9)I_{D2}=0.1I_{D2}.$$

This allows for 90% of the drain current $I_{D2}$ from transistor T2 to flow into the load. Thus only a small portion of $I_{D2}$ is diverted from the load. This is still a sufficient current to drive a load, while providing a nonzero drain current $I_{D10}$ flowing in transistor T10. Other values for β, such as 0.95 or 0.98, can be selected.

The drain currents described above in relation to FIG. 5 corresponds to DC currents flowing in the transistors T2-T10. When there are fluctuations in the supply voltage $V_{DD}$, such as noise in the supply voltage $V_{DD}$, a small signal AC current, or noise current, will also flow in the transistor T10 and thus draw this portion of the current out of T2 instead of letting it flow through the load.

Figure 6:
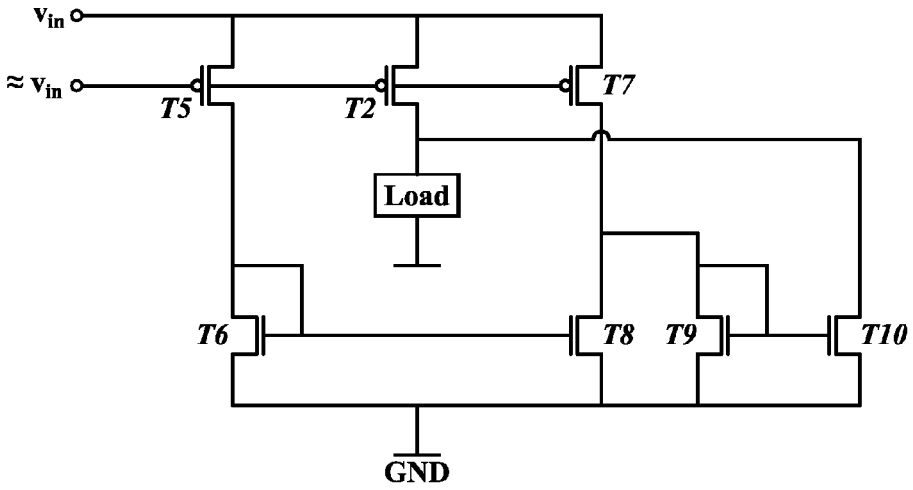
FIG. 6 is a small signal representation of the current mirror circuit of FIG. 5 according to one embodiment.

FIG. 6 is a small signal representation of the circuit of FIG. 5 in which noise or fluctuations on the supply voltage $V_{DD}$ are modeled as the small signal voltage $v_{in}$. The small signal current i flowing in a transistor is approximated by the expression $$i=v_{in}/r_0,$$

where $v_{in}$ is the small signal voltage and $r_0$ is the output resistance of the transistor. (In these equations, upper case I is the symbol for the DC current, and lower case i is the symbol for the small signal current.) The small signal current $i_2$ flowing in transistor T2 is therefore given by:

$$i_2=v_{in}/r_{02}.$$

The small signal current flowing in transistor T7 is given by:

$$i_7=v_{in}/r_{07}.$$

The small signal currents flowing in transistors T5 and T6 are given by:

$$i_5=v_{in}/r_{05}=i_6.$$

Because the width-to-length ratio of transistor T8 is scaled by a factor of with respect to the width-to-length ratio of transistor T6, the small signal current flowing in transistor T8 is given by:

$$i_8=\beta i_6=/r_{05}.$$

The small signal current flowing in transistor T9 corresponds to the portion of the small signal current $i_7$ from transistor T7 which does not flow through transistor T8. By selecting design parameters that ensure that the intrinsic gain of the diode connected transistors T1, T6, and T9 is high ($g_m r_0$>>1), the small signal current in transistor T9 is given by:

$$i_9=(v_{in}/r_{07}-\beta v_{in}/r_{05}).$$

Because transistors T9 and T10 are connected in a current mirror configuration in which the gate and source voltages of transistors T9 and T10 are the same, and because the width-to-length ratio of transistor T10 is scaled by factor of 1/α with respect to the width-to-length ratio of transistor T9, the small signal current flowing in transistor T10 is given by:

$$i_{10}=(1/\alpha)i_9=(1/\alpha)(v_{in}/r_{07}-\beta v_{in}/r_{05}).$$

As described previously the output resistance r0 of a transistor is generally proportional to the channel length of the transistor. Stated mathematically, $$r_0 \sim L.$$

Therefore, because the length of transistor T7 is scaled by a factor of γ with respect to the length of transistor T5 as described previously, the output resistance of transistor T7 is given by:

$$r_{07}=\gamma r_{05},$$

and $$r_{05}=r_{02}/\alpha.$$

Substituting these values for $r_{07}$ and $r_{05}$ into the expression for the small signal current $i_{10}$ of transistor T10, the small signal current $i_{10}$ can be expressed in terms of the output resistance $r_{02}$ of transistor T2:

$$i_{10}=(v_{in}/\alpha)(1/r_{07}-\beta/r_{05})=(v_{in}/\alpha)(\alpha/(\gamma r_{02})-\alpha\beta/r_{02}).$$

The term a cancels from the expression, leaving $$i_{10}=v_{in}(1/\gamma-\beta)/r_{02}.$$

Because the small signal current $i_2$ is given by:

$$i_2=v_{in}/r_{02},$$

the small signal current $i_{10}$ can be expressed in terms of the small signal current $i_2$:

$$i_{10}=v_{in}(1/\gamma-\beta)/r_{02}=(1/\gamma-\beta)i_2.$$

By carefully selecting the scalar factors γ and β, nearly all of the small signal current, or noise current, flowing in the load transistor T2 can flow through transistor T10. If β is selected to be 0.9 or less as described previously in relation to FIG. 5, then the value of γ can be selected to make the current $i_{10}$ equal to $i_2$. In particular, if β equals 0.9 then γ can be selected to equal 1/1.9. In this case the small signal current flowing in transistor T10 is given by:

$$i_{10}=(1/\gamma-\beta)i_2=(1/(1/1.9)-0.9)i_2=(1.9-0.9)i_2=i_2.$$

Thus, all of the small signal current $i_2$ flowing out of the load transistor T2 flows through transistor T10. This means that none of the small signal current $i_2$ flows through the load. Thus the load current is protected from fluctuations in the supply voltage $V_{DD}$.

Even if the parameter γ was selected to be even smaller so that transistor T10 were to conduct a larger current than the variable small current flowing through transistor T2, the circuit will be stable. At worst, a right-hand zero is introduced which will not affect stability of the circuit, while transistor T10 will conduct all of the noise current and some of the load current from transistor T2.

Thus the choice of a can be selected to achieve a desired DC current consumption in the auxiliary current paths of transistors T5 and T7. The currents in transistors T5 and T7, in conjunction with the width and length parameters of the other transistors in the noise canceling circuit 30, are selected to draw a particular drain current.

β can be chosen depending on the system design and mismatches that may occur at random in the circuit. The PSR curve is set by the main path, i.e., the path to the load. The bandwidth of the noise cancelling path is based, in part, on β. The bandwidth of the noise cancelling path should be large enough to include the frequencies at which PSR is needed. In one embodiment, β can be chosen to be very close to one to prevent any significant reduction of the DC current going into the load. β can also be selected to be significantly less than one to ensure the proper DC operating point of some of the transistors and be assured of sufficient current for full canceling of all noise by the noise canceling circuit 30.

The value of γ is selected to cancel the small signal AC noise current flowing into the load. The value for γ does not alter the DC current in transistor T7. Scaling the channel length of transistor T7 by γ scales the output resistance $r_{07}$ by γ.

In one example the current mirror circuit 20 is implemented in an integrated circuit utilizing the 20 nm technology node. The load is a voltage controlled oscillator in a phase locked loop. α is 0.2, β is 0.9, and γ is 0.5. The DC PSR can improve to −60 db or better with negligible impact on the mid-band of AC PSR. The phase noise contribution of the noise cancellation circuit in the voltage controlled oscillator is filtered by placing capacitor C3 in the auxiliary path to filter high-frequency thermal noise without impacting the bandwidth of the auxiliary path in frequencies of interest (e.g., up to 10 MHz). The phase noise contribution of the noise cancelling circuit is very small as it has a very low DC current in comparison to the DC current of the load. Hence, it has negligible impact on the overall phase noise numbers of the oscillator. Furthermore, a current mirror circuit 20 including a noise cancellation circuit as described in relation to FIGS. 4-6 can be implemented in very low voltage circuits while still canceling noise from the load. The noise canceling circuit is functional even at voltages lower than 1.0V.

A particular circuit design and particular values of α, β, and γ, have been disclosed in relation to FIGS. 5 and 6. However the particular design and these values are given only by way of example. Many other circuits and choices of channel widths and lengths can be utilized in conjunction with principles of the present disclosure to provide a stable load current to a load in spite of voltage fluctuations in the supply node as will be apparent to those of skill in the art in light of the present disclosure. All such other circuits and choices of design parameters fall within the scope of the present disclosure.

The various embodiments described above can be combined to provide further embodiments. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A device, comprising:

a load transistor configured to pass a load current having a DC component and a noise component therein to a node coupled to a load;

a bias circuit configured to bias the load transistor;

a voltage supply terminal coupled to the bias circuit and the load; and a noise diverting circuit configured to draw less than half of the DC component of the load current and more than half of the noise component of the load current from the load current after it passes through the load transistor and prior to it passing through the load.

2. The device of claim 1 wherein the bias circuit includes:

a current source configured to conduct a bias current; and a bias transistor configured to pass the bias current, a gate of the bias transistor being coupled to a drain of the bias transistor.

3. The device of claim 2 wherein a gate of the load transistor is coupled to the gate of the bias transistor.

4. The device of claim 1 wherein the noise diverting circuit includes a noise drawing transistor coupled to the load transistor and configured to draw the noise component of the current passing through the load transistor prior to it passing through the load.

5. The device of claim 1 wherein the voltage supply terminal supplies a voltage less than or equal to 1 Volt.

6. The device of claim 1 wherein the bias circuit is configured to generate a bias voltage.

7. The device of claim 6 wherein the bias voltage is supplied to respective gate terminals of the first, second, and third transistors.

8. The device of claim 7 wherein the first, second, and third transistors all receive a common supply voltage at respective source terminals.

9. A method, comprising:

passing a load current having a DC component and a noise component therein through a load transistor to a node coupled to a load;

biasing the load transistor via a bias circuit;

supplying a voltage to the bias circuit and the load; and drawing less than half of the DC component of the load current and more than half of the noise component of the load current from the load current after it passes through the load transistor and prior to it passing through the load.

10. The method of claim 9, comprising:

supplying a bias current;

passing the bias current through a bias transistor; and, coupling a gate of the bias transistor to a drain of the bias transistor.

11. The method of claim 10, comprising coupling a gate of the load transistor to the gate of the bias transistor.

12. The method of claim 9, comprising coupling a noise drawing transistor to the load transistor and drawing the noise component of the current passing through the load transistor prior to it passing through the load.

13. The method of claim 9 wherein the voltage is less than or equal to 1 Volt.

14. The method of claim 9, comprising generating a bias voltage by the bias circuit.

15. The method of claim 14, comprising supplying the bias voltage to respective gate terminals of the first, second, and third transistors.

16. The method of claim 15, comprising supplying a common voltage at respective source terminals of the first, second, and third transistors.

* * * * *